US005829903A

United States Patent [19]

Collins

[11] Patent Number: 5,829,903

[45] Date of Patent: Nov. 3, 1998

[54] WRITING IMPLEMENT AND CAP THEREFOR HAVING AN INTEGRAL BOOKMARK

[76] Inventor: Steven J. Collins, 68 Fox Run, Cranston, R.I. 02921

[21] Appl. No.: 224,163

[22] Filed: Apr. 7, 1994

[51] Int. Cl.[6] ..... B43K 9/00; B42D 9/00

[52] U.S. Cl. ..... 401/131; 401/202; 401/213; 281/30

[58] Field of Search ..... 116/234, 237, 116/238; 401/202, 213, 131, 34; 281/30

[56] References Cited

U.S. PATENT DOCUMENTS

| | | | |
|---|---|---|---|
| 155,196 | 9/1874 | McHair . | |
| 2,300,216 | 10/1942 | Grodsky et al. . | |
| 3,733,139 | 5/1973 | Neidharht et al. | 401/34 X |
| 5,016,559 | 5/1991 | Larson et al. . | |
| 5,095,846 | 3/1992 | Knight . | |

FOREIGN PATENT DOCUMENTS

| | | | |
|---|---|---|---|
| 8626 | 5/1891 | European Pat. Off. | 281/30 |
| 529875 | 11/1940 | European Pat. Off. | 281/30 |
| 2494637 | 5/1982 | France | 401/34 |
| 513735 | 5/1956 | Germany | 116/234 |

*Primary Examiner*—Steven A. Bratlie
*Attorney, Agent, or Firm*—Salter & Michaelson

[57] ABSTRACT

A writing implement includes a ball point pen and corresponding cap at one end, and a highlight marker and corresponding cap at the other end. The highlight marker cap includes an integral blade portion which functions as a bookmark. The writing implement and cap are adapted to be slidably received over the spine of a book wherein the blade portion of the highlight marker cap extends downwardly between the pages of the book, and the body of the writing implement extends downwardly along the outside of the book spine.

11 Claims, 2 Drawing Sheets

WRITING IMPLEMENT AND CAP THEREFOR HAVING AN INTEGRAL BOOKMARK

BACKGROUND AND SUMMARY OF THE INVENTION

The instant invention relates to writing implements, and more specifically to a writing implement having a cap which includes an integral bookmark.

Bookmarks which incorporate means for holding a writing implement have heretofore been known in the art. In this regard, the U.S. Patents to McNair No. 155,196; Grodsky et al No. 2,300,216; Larson et al No. 5,016,559; and Knight No. 5,095,846 represent the closest prior art to the subject invention of which the applicant is aware. The patents to McNair, Grodsky et al and Larson et al each describe a bookmark made out of a flat sheet material and having resilient clip means at one end thereof for removably receiving a writing implement, such as a pen or pencil. The writing implement is removable from the bookmark to take notes or to underline relevant portions of the book text. The patent to Knight discloses a bookmark adapted to be positioned over the top edge of a book spine with an inner leg thereof extending downwardly between the pages of the book, and an outer leg extending downwardly along the outside of the spine. The outer leg includes a resilient clip for holding a writing implement.

The instant invention provides a writing implement having a pen and a corresponding cap at one end, and a highlight marker and a corresponding cap at the other end. The highlight marker cap includes an integral blade portion which function as a bookmark. The writing implement and highlight marker cap are adapted to be slidably received over the spine of a book wherein the blade portion of the marker cap extends downwardly between the pages of the book, and the body of the writing implement extends downwardly along the outside of the book spine.

Accordingly, it is an object of the instant invention to provide a writing implement having a pen at one end and a highlight marker at the other end.

It is another object to provide a writing implement having a cap which includes an integral blade portion that is receivable over the top edge of the spine of a book to mark a position therein.

It is still another object to provide a cap for a writing implement having an integral blade portion that is receivable over the top edge of the spine of a book to mark a position therein.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
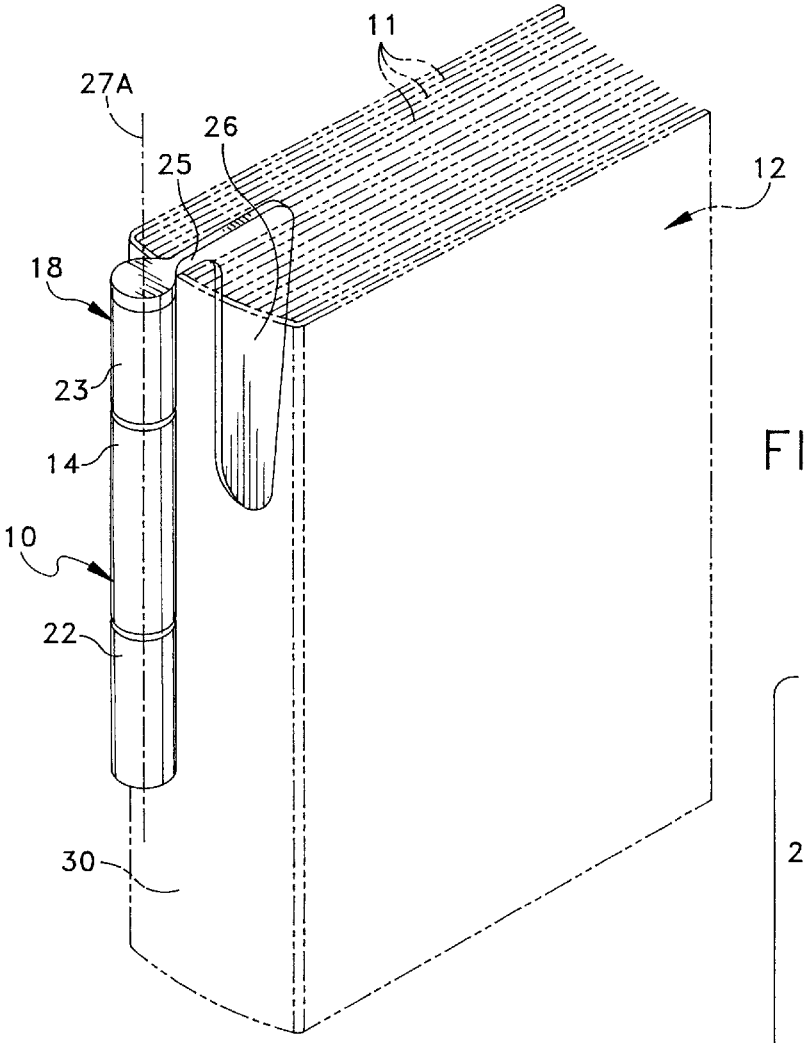
FIG. 1 is a perspective view of the instant writing implement with the blade portion of the marker cap received over the spine of a book.

Referring now to the drawings, the writing implement of the instant invention is illustrated and generally indicated at

Figure 3:
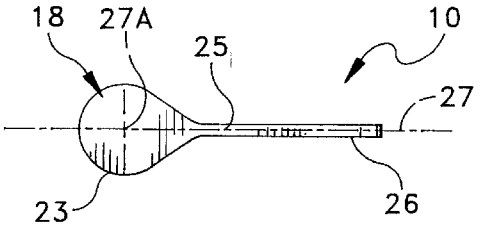
FIG. 3 is a top view thereof.
Figure 4:
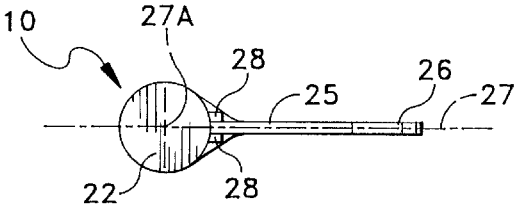
FIG. 4 is a bottom view thereof.
Figure 2:
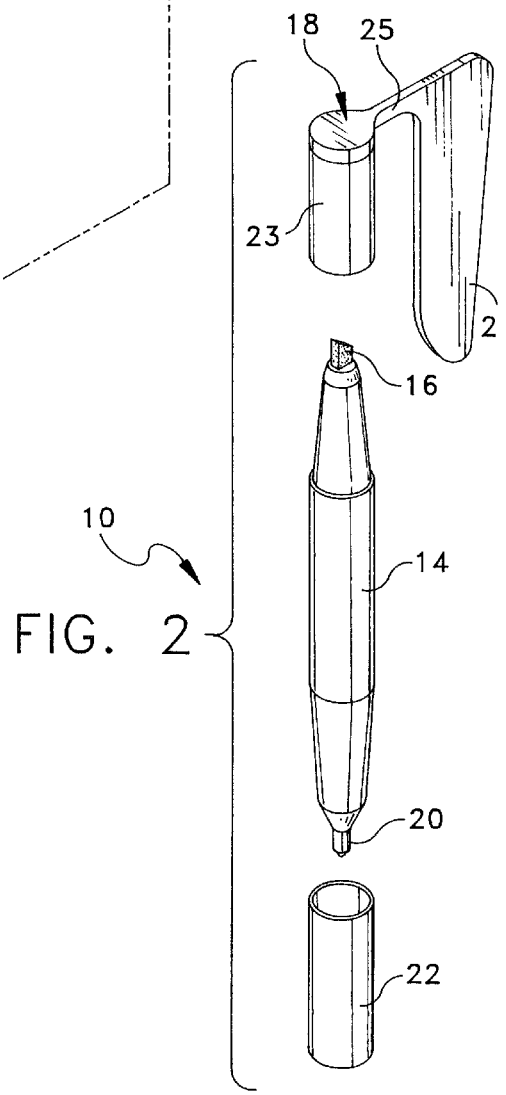
FIG. 2 is an exploded perspective view thereof.
Figure 5:
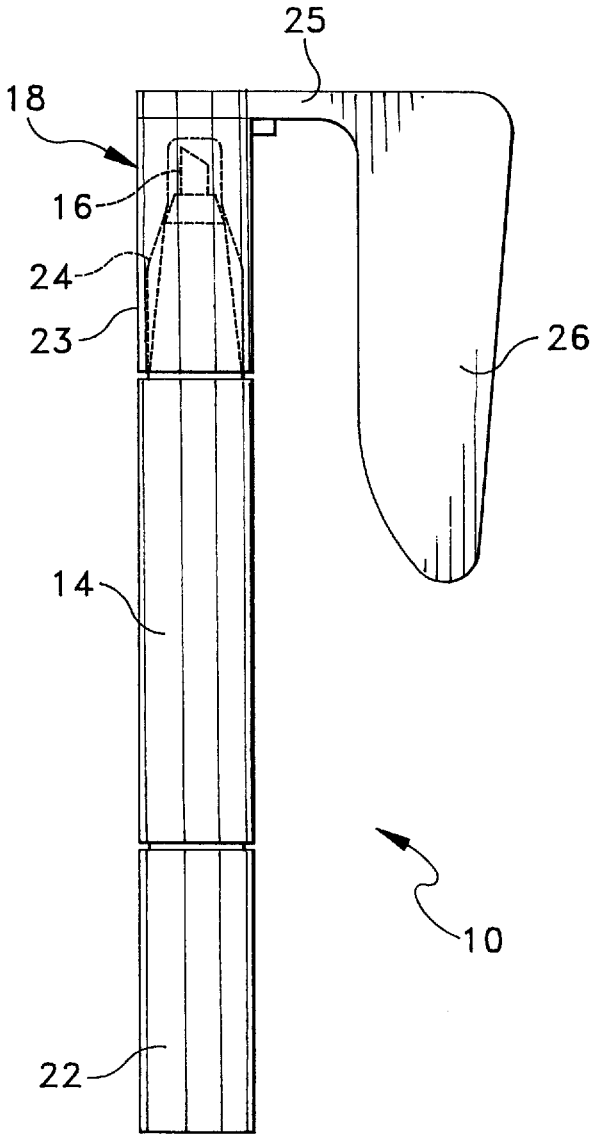
FIG. 5 is a side view thereof.

10 in FIGS. 1–5. As will hereinafter be more fully described, the instant writing implement 10 includes a cap having an integral blade portion which is received between the pages 11 of a book generally indicated at 12 for marking a position therein.

The writing implement 10 comprises a body 14 having a highlight-type marker 16 and a corresponding cap generally indicated at 18 at a first end, and a ball point pen 20 and corresponding cap 22 at the second end thereof. While the two writing instruments embodied in the instant invention have been specifically described as a highlight marker 16 and a ball point pen 20, it is to be understood that all types of writing instruments are contemplated within the scope of the invention. For example, the ball point pen 20 could be interchanged with a roller ball pen. The body 14 is generally cylindrical in shape and its construction, including the combination highlight marker 16 and ball point pen 20, is conventional in the art. The cap 22 for the ball point pen 20 is conventional in construction and it is removably received over the ball point pen 20 when the pen 20 is not in use. The highlight marker cap 18 includes a body portion 23 which is removably received over the highlight marker 16 when the marker 16 is not in use. In this connection, the body portion 23 includes a longitudinal contoured recess 24 which is operative for frictionally receiving and holding the tip of the marker 16. The highlight marker cap 18 further includes a radial arm portion 25 extending outwardly therefrom and a blade portion 26 extending downwardly from the arm portion 25 so as to be positioned in closely spaced, generally parallel relation to the body 14 when the marker cap 18 is assembled with the body 14. The blade portion 26 extends radially in a plane 27 which includes an axial line 27A passing longitudinally through the center of said body portion 23 of the cap 18. It is pointed out that the arm portion 25 is somewhat thicker adjacent to the cap 18 and tapered toward the blade portion 26 to provide a strong support for the blade portion 26. The arm portion 25 further includes reinforcements 28 to provide additional support and strength to the arm/cap interface. The blade portion 26 has a thickness which is appropriate for receipt between the pages 11 of the book 12 for marking a position therein.

In use, the pen cap 22 and marker cap 18 are normally assembled with the body 14 to cover the pen 20 and marker 16. (See FIG. 5). For use in marking a position in a book 12, the assembled writing implement 10 is slidably received over the top edge of the spine 30 of the book 12 wherein the blade portion 26 of the marker cap 18 extends downwardly between the pages 11 of the book 12, and the body 14 extends downwardly along the outside of the book spine 30. (See FIG. 1). The highlight marker 16 and pen 20 are operable for either highlighting or underlining relevant portions of text in the book 12, or the pen 20 is useful for taking notes.

In a second embodiment, (not shown) the writing implement comprises a body with only one writing instrument, such as a highlight marker, and a corresponding cap including an integral bookmark blade.

It can therefore be seen that the instant invention provides a unique writing implement 10 and cap 18 therefor which also functions as a bookmark when the writing instrument is not in use. The pen 20 is operative for writing notes, or underlining text, while the highlight marker 16 is operative for highlighting desired portions of the text of a book 12. The blade portion 26 of the highlight marker cap 18 easily slides over the top edge of the spine 30 of the book 12 and between the book pages 11 to mark a position therein. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. In combination:

a writing implement comprising an elongated body and a writing instrument situated at one end of said body; and a cap comprising a body portion and a recess in said body portion for removably receiving a tip of said writing instrument when not in use, said cap further including an arm portion extending outwardly from said body portion and a blade portion extending downwardly from said arm portion so as to be positioned in spaced relation to said writing implement when said cap is assembled with said writing implement, said blade portion extending radially in a plane which includes an axial line passing longitudinally through said body portion, said cap being slidably received over a spine of a book wherein said blade portion of said cap extends downwardly between pages of a book and said writing implement extends downwardly along an outside surface of a book spine.

2. In the combination of claim 1, said writing instrument comprising a highlight marker.

3. In the combination of claim 1, said writing instrument comprising a ball point pen.

4. In the combination of claim 1, said writing instrument comprising a roller ball pen.

5. In the combination of claim 1, said blade portion extending downwardly from said arm portion so as to be positioned in closely spaced generally parallel relation to said body portion.

6. The combination of claim 1 wherein said axial line passes longitudinally through a center of the body portion of the cap.

7. A cap for a writing implement comprising:

a body portion including recess means for removably receiving the tip of a writing implement;

an arm portion extending outwardly from said body portion; and a blade portion extending downwardly from said arm portion so as to be positioned in spaced relation to said body portion, said blade portion extending radially in a plane which includes an axial line passing longitudinally through said body portion, said cap being slidably received over a spine of a book wherein said blade portion extends downwardly between pages of a book and said body portion extends downwardly along an outside of a book spine.

8. The cap of claim 7 wherein said arm portion is thicker toward said body portion and tapered toward said blade portion.

9. The cap for a writing implement of claim 7 wherein said axial line passes longitudinally through a center of the body portion of the cap.

10. In combination:

a writing implement comprising a body and a writing instrument situated at one end of said body; and a cap comprising a body portion and a recess in said body portion for removably receiving a tip of said writing instrument when not in use, said cap further including an arm portion extending outwardly from said body portion and a blade portion extending downwardly from said arm portion so as to be positioned in spaced relation to said writing implement when said cap is assembled with said writing implement, said arm portion having a thicker dimension adjacent said body portion and tapering toward said blade portion, said blade portion extending radially in a plane which includes an axial line passing longitudinally through said body portion, said cap being slidably received over a spine of a book wherein said blade portion of said cap extends downwardly between pages of a book and said writing implement extends downwardly along an outside surface of a book spine.

11. The combination of claim 10 wherein said axial line passes longitudinally through a center of the body portion of the cap.

* * * * *